US006152497A

United States Patent [19]

Vickers et al.

[11] Patent Number: 6,152,497

[45] **Date of Patent: *Nov. 28, 2000**

[54] MULTI-POINT LATCHING SYSTEM

[75] Inventors: James H. Vickers, Middletown Township, Delaware County, Pa.; David Milne, Lima, N.Y.; Richard E. Schlack, Rising Sun, Md.

[73] Assignee: Southco, Inc., Concordville, Pa.

[ * ] Notice: This patent is subject to a terminal disclaimer.

[21] Appl. No.: 09/293,292

[22] Filed: Apr. 16, 1999

Related U.S. Application Data

[63] Continuation of application No. 08/955,688, Oct. 22, 1997, Pat. No. 5,938,248.

[60] Provisional application No. 60/061,355, Oct. 8, 1997.

[51] Int. Cl.[7] ..... E05C 1/06; E05C 1/12; E05C 7/00; E05C 9/10

[52] U.S. Cl. ..... 292/34; 292/36; 292/23; 70/118

[58] Field of Search ..... 292/36, 9, 15, 292/23, 34, 35, 37, 229, 119, 120, 193, 139; 70/118, 208

[56] References Cited

U.S. PATENT DOCUMENTS

| | | | |
|---|---|---|---|
| 2,594,253 | 4/1952 | Vander Veer | 292/92 |
| 2,732,235 | 1/1956 | Schemers | 292/34 |
| 4,237,710 | 12/1980 | Cardozo | 70/108 |
| 4,470,277 | 9/1984 | Uyeda | 70/118 |
| 4,893,849 | 1/1990 | Schlack | 292/7 |
| 5,375,894 | 12/1994 | Schlack | 292/36 |
| 5,911,763 | 6/1999 | Quesada | 70/120 |
| 5,938,248 | 8/1999 | Vickers et al. | 292/36 |

OTHER PUBLICATIONS

Product brochure, "Rod Roller Compression System," Southco, Inc., Concordville, PA., (1 page), 1995.

*Primary Examiner*—Lynne H. Browne
*Assistant Examiner*—John B. Walsh
*Attorney, Agent, or Firm*—Paul & Paul

[57] ABSTRACT

A multi-point latching system is adapted for mounting on a panel and securing the panel to a frame. The system includes a central latch, remote latches and connecting rods. The central latch includes a housing and a handle assembly pivotably mounted in the housing for rotation about an axis parallel to the panel for opening and closing the central latch. The handle assembly extends through the housing and includes a handle and a pivot arm. The pivot arm extends from the back of the housing. The central latch also includes an actuator pivotably mounted for rotation normal to the panel; and a link connecting the handle assembly to one of the connecting rods, which is also connected to the actuator, such that the actuator is rotated by rotating the handle assembly. The remote latches are engaged by rotation of the actuator plate through the connecting rods.

6 Claims, 7 Drawing Sheets

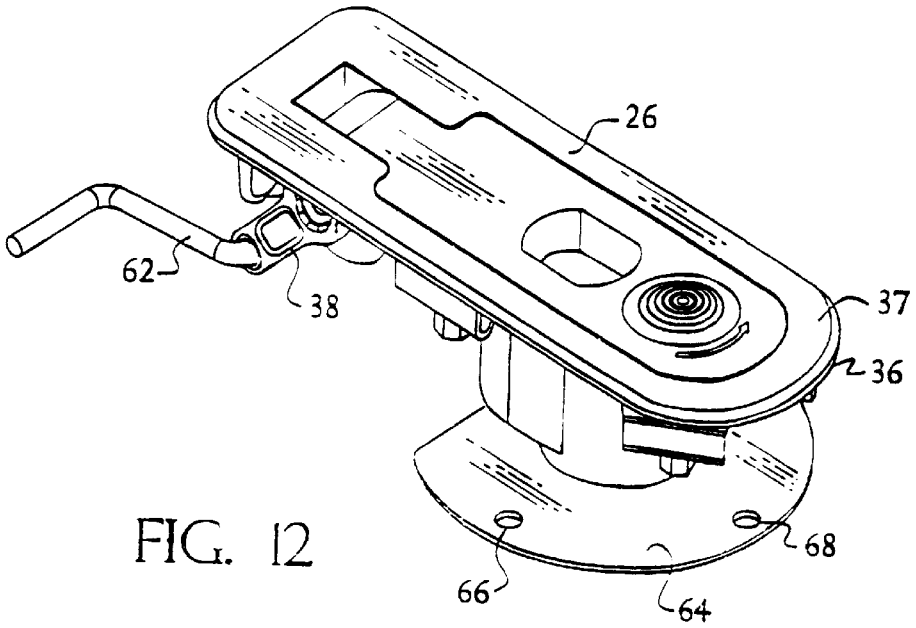
FIG. 12
FIG. 13
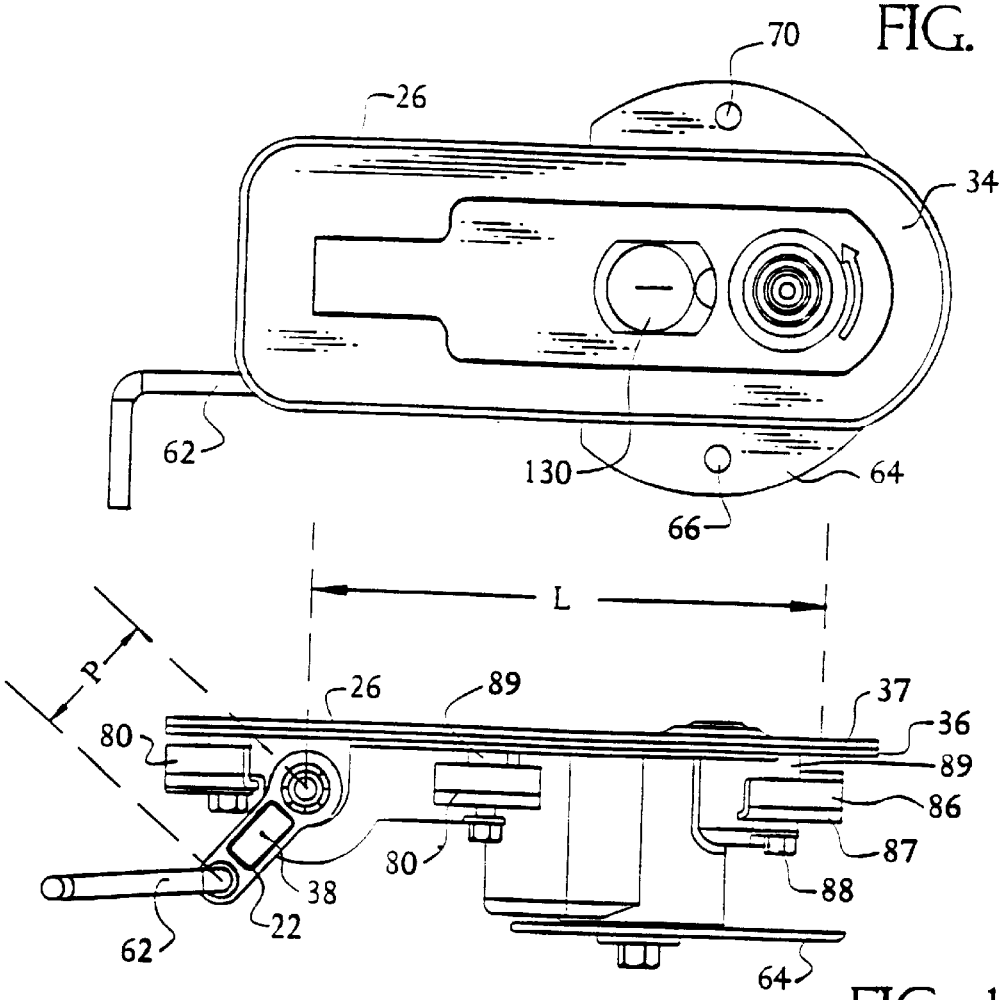
FIG. 14

MULTI-POINT LATCHING SYSTEM

CROSS-REFERENCE TO RELATED APPLICATIONS

This application claims the benefit of U.S. Provisional Application No. 60/061,355, filed Oct. 8, 1997, entitled "Multi-Point Latching System," and is a continuation of Ser. No. 08/955,688, filed Oct. 22, 1997, now U.S. Pat. No. 5,938,248.

BACKGROUND OF THE INVENTION

1. Field of the Invention

The present invention relates generally to latching devices, and more particularly to systems for latching hinged doors or panels and the like at multiple points.

2. Background of the Invention

Various types of latching devices for fastening doors, panels and the like are known.

In certain applications, such as in the case of doors or panels which need to be sealed when closed, multiple point latching systems are advantageously employed. In such systems, multiple latches are installed at or near the periphery of the door or panel to be sealed. The multiple latches can be individually actuated. However, it is a convenience if they are arranged to be actuated by a single central actuator. An example of a known multiple point actuating system is the VICE ACTION® 3-point compression system available from Southco, Inc., Concordville, Pa. In this system a pair of over-center latches are mounted on the door or panel to be secured, proximate the periphery. Often a compressible gasket will be provided between the door or panel and the corresponding frame or cabinet. A central operating latch is mounted in the panel between the over-center latches. The central operating latch, which can be rotated around an axis perpendicular to the plane of the panel, includes an actuator rod or plate which rotates when the latch is turned. The central operating latch also includes a handle or knob, which extends above the surface of the panel, or a fitting for a tool to be inserted for rotating the central operating latch. A pair of rods extend from the actuator plate to the over-center latches, so that as the central latch is rotated the over-center latches are each actuated, as the rods move in a plane parallel to the panel. The over-center action first latches, and then compresses the gasket, as the central latch is rotated, thereby both latching and sealing the panel against the frame. Alternatively, other types of remote latching mechanisms can be substituted for the over-center latches, such as roller devices.

This system is highly effective in many applications. However, in some applications the gasket may be made of rubber or another material which tends to harden with age or environmental exposure, making the gasket more difficult to compress. In some cases, large panels may require large over-center latches to secure the panels, requiring correspondingly greater force to operate them. However, the amount of force which can exerted to seal the over-center latches is limited by the size of the handle, knob or tool used to turn the central operating latch. Further some applications, the protrusion of a knob or handle from the panel may not be desirable, from an esthetic or other perspective.

Thus, there is a need for a multi-point latching system with increased mechanical advantage over prior art systems, thereby making it easier to securely latch and seal large door and panels.

Similarly, there is a need for a multi-point latching system which includes a central operating latch which can be mounted flush in the panel surface.

These needs are met by the present invention, as hereinafter described.

SUMMARY OF THE INVENTION

The multi-point latching system of the present invention provides greater mechanical advantage when the latching system is closed or open, in comparison with prior art systems, permitting cabinet doors as large as 6 feet high by 2 or 3 feet in width to be easily and reliably latched and sealed. Further, the multi-point latching system of the present invention advantageously provides an ergonomically superior latching system, in that latching and sealing requires the application of force down and away from the person operating the latch, in comparison with prior art systems which require force to be applied in rotating a handle, knob or tool around an axis perpendicular to the surface of the cabinet door. The multi-point latching system of the present invention also advantageously provides enhanced security in comparison with prior art devices, in that when closed and latched the latch system is more difficult to force open or vandalize, because the operating element does not protrude above the surface of the cabinet door.

The present invention provides a multi-point latching system adapted for mounting on a panel and securing the panel to a frame. This system comprises, first, a central latch including (1) a housing having a back, (2) a handle assembly pivotably mounted in the housing for rotation about an axis parallel to the panel for opening and closing the central latch; (3) an actuator pivotably mounted for rotation normal to the panel; and (4) link means connecting the handle assembly and the actuator such that the actuator is rotated by rotating the handle assembly. In the central latch, the handle assembly extends through the housing and includes a handle and a pivot arm, and the pivot arm extends from the back of the housing. The system also includes at least one remote latching means for securing the panel to the frame; and connection means extending between the actuator and the at least one remote latching means such that the at least one remote latching means is operated when the actuator is rotated.

Preferably, the system comprises at least a first connection means and a second connection means and respective first and second remote latching means. In this case, the link means connects the handle assembly with the actuator and includes the first connection means. It is also presently preferred that the link means further comprises a link member, and that the link member be pivotably attached both to the handle assembly and to the first connection means.

It is preferred that the handle assembly include a pivot arm extending from the back of the housing, and the link member be pivotably attached to the pivot arm for rotation about an axis which remains parallel to the plane of the panel as the central latch is operated.

Preferably, the link member is pivotably attached to the connection means for rotation about an axis which remains parallel to the plane of the panel as the central latch is operated.

It is also presently preferred that the at least one remote latching means include at least one roller means. Alternatively, the at least one remote latching means includes an over-center latch.

Preferably, the handle assembly includes both a handle and the pivot arm, and the handle assembly is mounted in the housing for rotation about a first pivot axis, while the link means is pivotably mounted to the pivot arm for rotation about a second pivot axis.

Regarding the mechanical advantage provided the present invention, preferably, where the handle extends a distance L from the first pivot axis, the distance from the first pivot axis to the second pivot axis being P, and the ratio L/P is at least 2.5/1, and more preferably at least 4/1.

In the multi-point latching system of the present invention, the handle assembly preferably also includes a locking member adapted for disengaging movement by an operator from a first position to a second position, as well as a first biasing means for returning the locking member from the second position to the first position when the operator releases the locking member. In this case, the housing further includes keeper means for engaging the locking member when the locking member is in the first position, and the locking member is disengaged from the keeper means in the second position. Further, the central latch preferably includes second biasing means for rotating the handle assembly out of the housing when an operator disengages the locking member, and the locking member is disengaged by rotation. Preferably, the housing further includes camming means for engaging and rotating the locking member from the first position as the handle assembly is rotated into the housing by an operator to close the central latch.

The present invention also provides an enclosure or cabinet equipped with the multi-point latching system described above.

BRIEF DESCRIPTION OF THE DRAWINGS

FIG. 12 is a partial perspective view of a third embodiment of the multi-point locking system of the present invention showing the handle adapted to receive a key lock cylinder.

FIG. 13 is a top plan view of the multi-point locking system of FIG. 12 showing a key lock cylinder mounted in the handle and multiple screw clamps for securing the central operating latch to a door.

FIG. 14 is a side elevational view of the multi-point locking system of FIGS. 12 and 13.

DETAILED DESCRIPTION OF THE PREFERRED EMBODIMENTS

Figure 1:
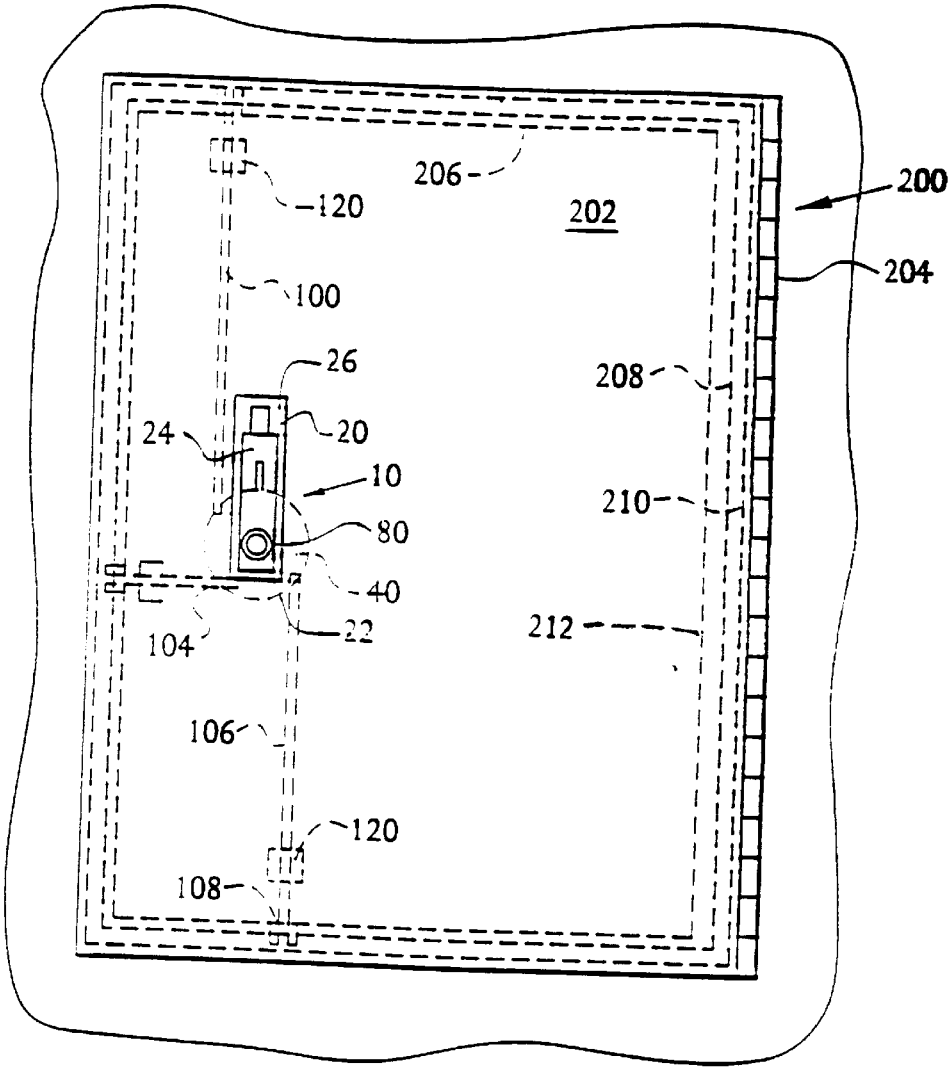
FIG 1 is a front elevational view of a multi-point latching system of the present invention shown mounted in a door of a cabinet, partially broken away, for securing the door to a cabinet frame, the door being shown in a closed and latched position.

Referring now to the drawings in detail, wherein like reference numerals indicate like elements throughout the several views, there is shown in FIG. 1 a front elevational view, partially broken away, of an enclosure or cabinet 200 having a multi-point latching system 10 of the present invention mounted on a hinged panel or door 202 thereof. The door 202 is mounted to the cabinet 200 by a hinge 204 and covers an opening 206 (shown in phantom) in the cabinet 200, the opening having the same general shape as the door 202, but being slightly smaller in size so that the door 200 extends beyond the opening 206 when the door 200 is closed. The portion of the cabinet 200 proximate the opening 206 serves as a frame 208 for the door. A gasket 210 made from a compressible material is affixed on the underside of the door 202 proximate the periphery thereof to help seal the cabinet 200 when the door 202 is closed. The cabinet 200 and door 202 may be fabricated from any suitable material (such as sheet steel) for enclosing various equipment (not shown) installed therein. The door or panel 202 need not be hinged, and the multi-point latching system 10 of the present invention is suitable for securing removable panels and the like (not shown). The multi-point latching system 10 of the present invention is particularly suitable for securing and sealing against the weather and adverse environments enclosures for electrical equipment.

Figure 7:
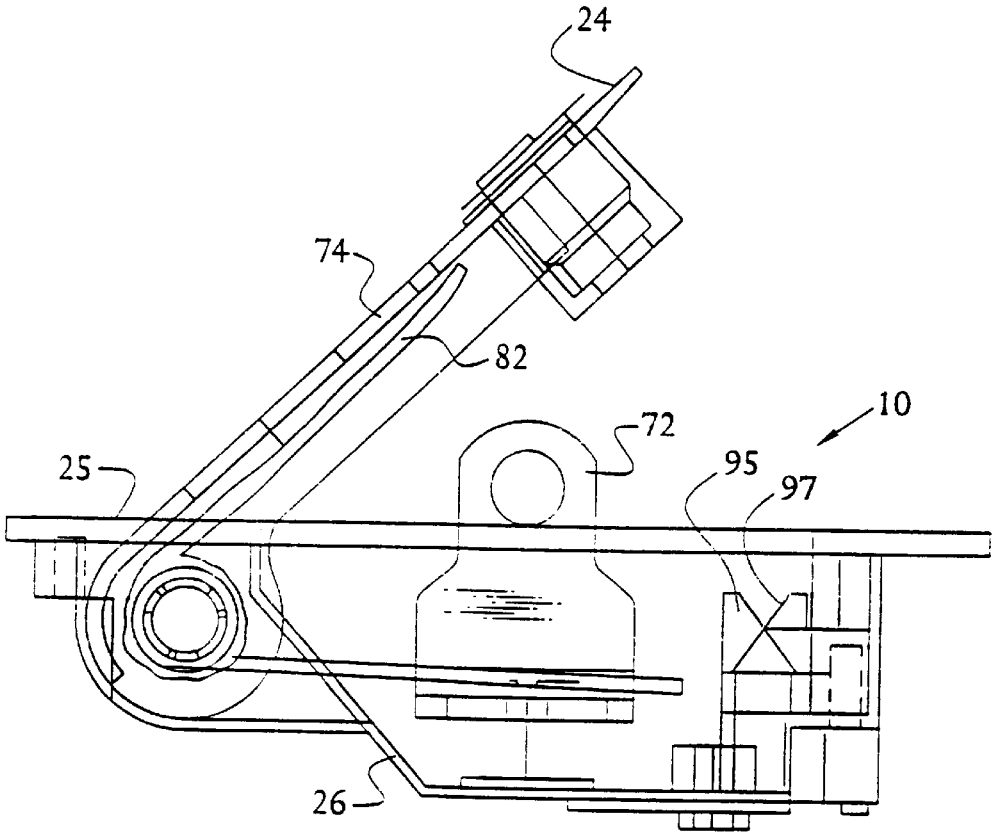
FIG. 7 is a partial sectional view of the handle and housing of FIG. 4 taken along the line 7—7 of FIG. 4, but showing the handle in a partially open position.
Figure 11:
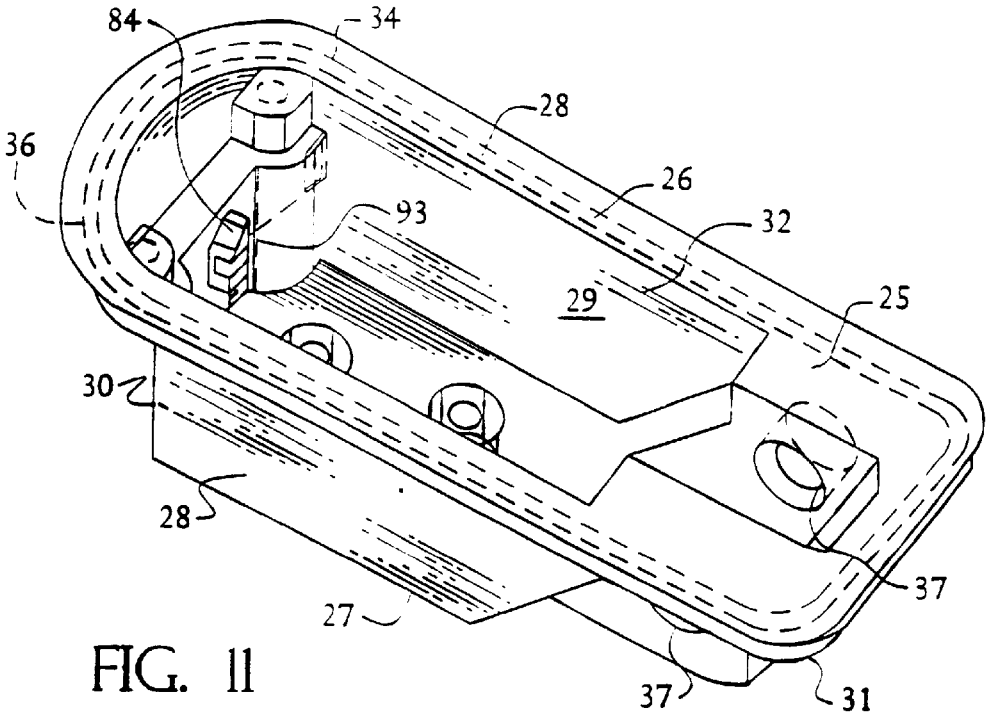
FIG. 11 is a perspective view of a housing adapted for receiving the handle of FIGS. 9 and 10.

The multi-point latching system 10 includes a central latch 20 having a handle assembly 22 and housing 26. The handle assembly 22 includes a handle 24 pivotably mounted in the housing 26 and extends through the housing 26 and into the interior of the cabinet 200. When the central latch 20 is closed and secured, the handle 24 is disposed within the generally box-shaped housing 26. As discussed in greater detail below, an operator opens the central latch 20 by disengaging a locking member or catch 80, whereupon the handle 24 is urged to rotate partially out of the housing 26 by a biasing means or main torsion spring 82 (FIG. 7). As can be best seen in FIG. 3, the operator can then grasp the handle 24 and complete the rotation to a position roughly perpendicular to the surface of the door 202. In so doing, the operator unlatches or opens the multi-point latching system 10, so that the door 202 may be swung open (or panel removed, in the case of a panel which is not secured to the enclosure by hinges). The multi-point latching system 10 is latched or closed by the operator by rotating the handle 24 back into the housing 26. Preferably, the central latch 20 is mounted in the door 202 so that the handle 24 is pulled up and away from the door 202 to open and pushed down toward the door 202 to close. In closing the central latch 20 mounted in this manner the operator can easily exert substantial force, in an ergonomically acceptable manner, so that even large, gasketed doors and panels, fitted with the multi-point latching system 10 of the present invention, can be easily latched and sealed by an operator The generally box-shaped housing 26 is mounted in an aperture or opening 212 formed in the door 202 (FIG. 1). As best seen in FIG. 11, the housing 26 has a an outer surface 25, and is a generally rectangular, cup-like member which can be formed of a suitable material such as by die-casting zinc metal. However, the housing 26 can be produced by any appropriate material by any appropriate method. For example, the housing 26 can be formed by molding a suitable thermoplastic resin material. The housing comprises a bottom plate 27, and a pair of generally parallel side walls 28, 29 and first and second end walls 30, 31 extending up from the bottom plate 27. A well 32 is formed between the respective side walls 28, 29 and end walls 30, 31 for receiving and housing the handle 24 portion of the handle assembly 22 when in the closed position. A flange 34 is also provided extending outward from the free ends of the side walls 28, 29 and the end walls 30, 31 for abutting an outer surface of the door 202. A sealing means of the gasket type 36 is affixed to the underside of the flange 34 for sealing the flange 34 against the outer surface of the door 202 when the housing 26 is mounted therein. Preferably, the flange 34 of the present invention is sized to prevent the passage of matter around the central latch 20, through the aperture 212, and into the interior compartment of the cabinet 200. Accordingly, at times it is desirable to incorporate a larger sized flange, such as about 5 millimeters or more in width, in order to account for imperfections in the preparation of the door 202 when the housing 26 is mounted therein. The housing 26 also includes a pair of opposed, aligned openings 37 formed in the side walls 28, 29 proximate one end of the housing 26, for mounting the handle assembly 22 as described below. The openings 37 are centered on an axis which is parallel to the surface of the door or panel 202 when the central latch 20 is installed.

The central latch 20 is preferably a sealed-type latch, such as that disclosed in U.S. Pat. No. 5,267,762 (which is hereby incorporated by reference). Preferably, housing 26 is securely fastened to the inside of the door 202 by a plurality of screw clamps 86 FIG. 14, each comprising a clamp member 87 and screw 88, the screws 88 being received in mounting lugs 89 molded into the housing 26. The screw clamps 86 are adapted to securely pull the flange 34 down and compress the gasket 36 between the flange 34 and the outer surface of the door 202 when the screws 88 are turned to tighten the clamp members 87 against the inner surface of the door 202 (not shown), thereby sealing the periphery of the central latch 20 against the door 202.

In addition, the handle assembly 22 and housing 26 preferably form an integral solid structure, such as disclosed in U.S. Pat. No. 5,267,762, and shown in the cross-sectional view of FIG. 6, for preventing the passage of matter through the central latch 20.

Figure 9:
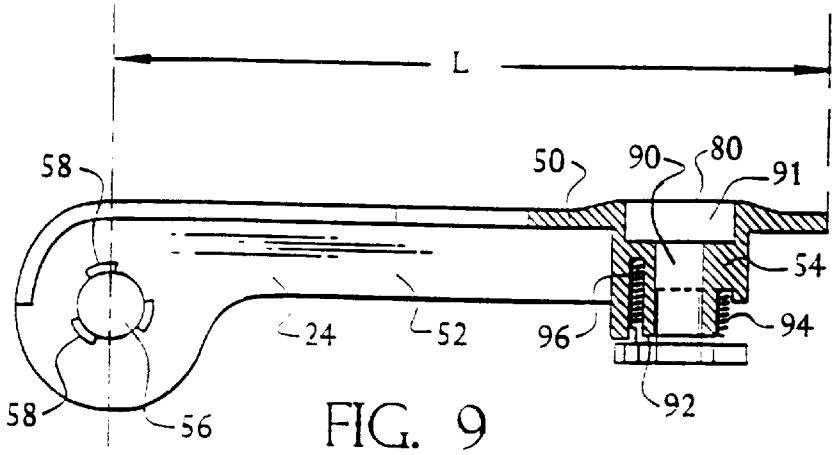
FIG. 9 is a partial sectional view of a second embodiment of the present invention showing a handle with a cross-pin mounted on the locking stud.
Figure 10:
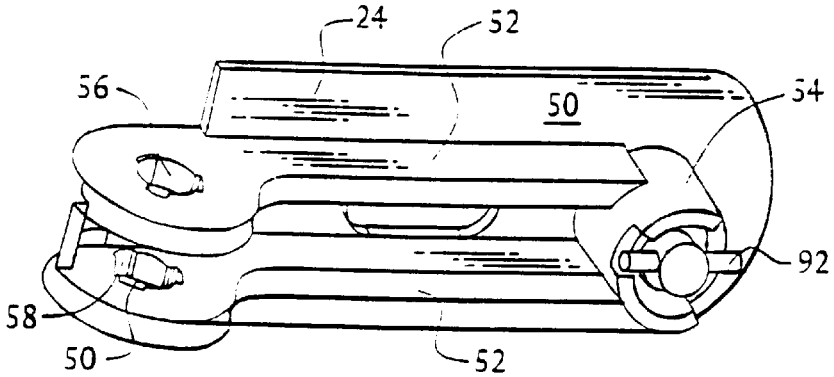
FIG. 10 is a perspective view of the handle of FIG. 9 as seen from below.

As best seen in the cross-sectional view of FIG. 9 and the perspective view of FIG. 10, the handle 24 includes an elongated, generally planar upper wall 50 and a pair of parallel side walls 52 extending downwardly (or, when the central latch 20 is closed, inwardly) therefrom. A generally cylindrical lock housing 54 for mounting a locking member or catch 80 extends from the upper wall 50 between the side walls 52 proximate one end of the handle 24. A pair of opposed, aligned generally circular openings 56 are formed in respective side walls 52 proximate the other end of the handle 24. A plurality of key ways 58 are formed in the openings 56.

Figure 3:
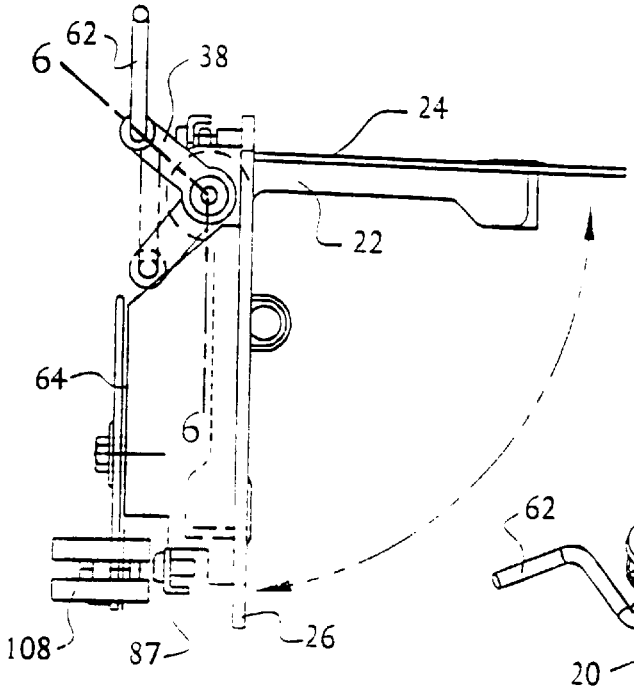
FIG. 3 is a partial side elevational view of a portion of the multi-point latching system of FIG. 2 shown in both the closed position and the open position (in phantom) to illustrate the action of the handle assembly and associated link.
Figure 5:
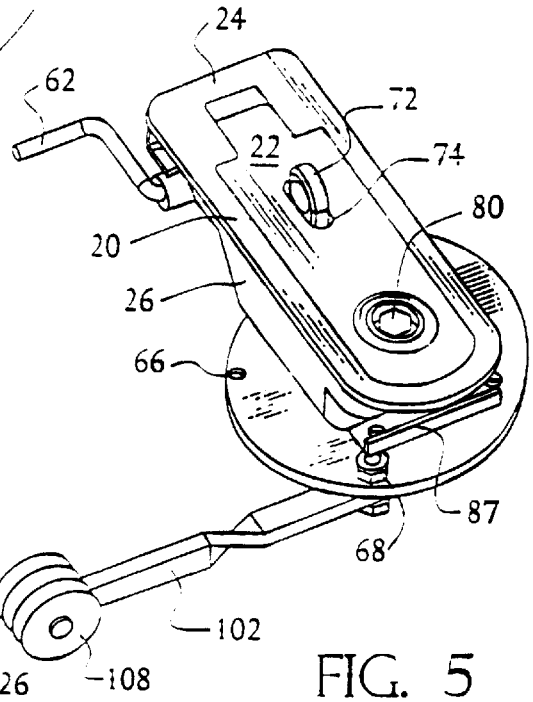
FIG. 5 is perspective view of the portion of the multi-point latching system of FIGS. 3–4.

As best seen in the partial side elevational views of FIGS. 3 and 14, the handle assembly 22 also includes a pivot arm 38 rigidly secured to the handle 24 in a fixed, predetermined relative orientation (about 135 degrees).

Figure 15:
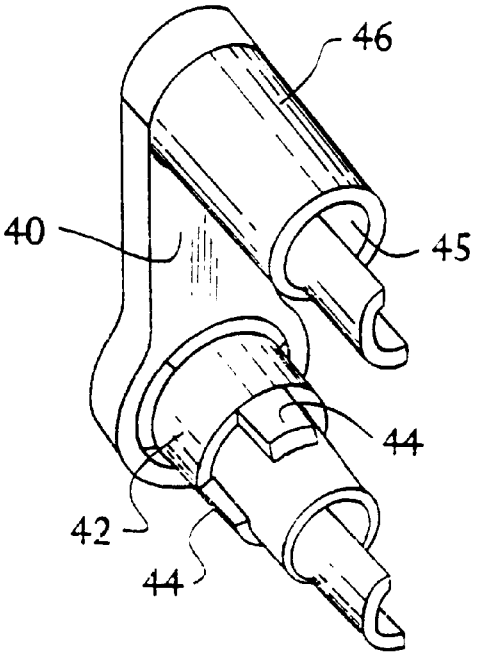
FIG. 15 is a perspective view of a first lever arm member.
Figure 16:
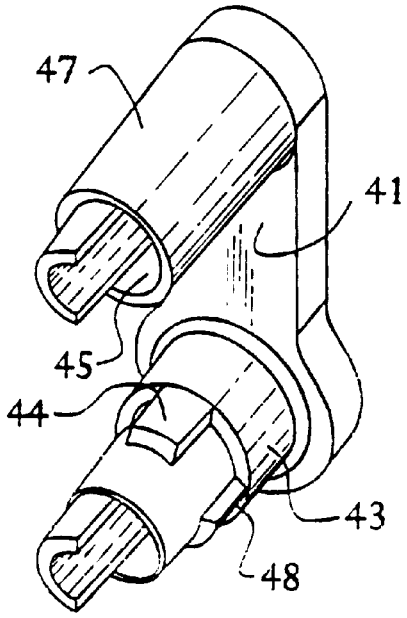
FIG. 16 is a perspective view of a second lever arm member.

As shown in the perspective views of FIGS. 15 and 16, the pivot arm 38 is comprised of a first and a second lever arm member 40, 41, each having a respective first shaft 42, 43 extending from a respective first end thereof. The first shafts 42, 43 are configured to be received within the openings 37 formed in the housing 26 (FIG. 11) and the openings formed in the side walls 52 of the handle 24. Each first shaft 42, 43 include a plurality of keys 44 formed thereon and adapted to be received and press fit within respective key ways 58 formed in the side walls 52 of the handle 24 (FIG. 10). However, any appropriately configured first shafts and openings in the side walls of the handle may be provided for such purpose. As shown in FIGS. 15 and 16, the first shafts 42, 43 are also formed in such a manner to matingly interconnect along the distal ends thereof, thereby forming a one piece integral shaft member upon assembly.

Preferably, a means of permanently securing the first shafts 42, 43 is also provided. For example, a screw and nut may be provided to extend through the assembled first shafts 42, 43. In the alternative, the first shaft 42 of the first lever member 40 may include an integral rivet member formed thereon and protruding outwardly therefrom (not shown), the rivet member being adapted to be received and peened over within an appropriately configured receptacle of the first shaft 43 of the second lever member 41 for completing the assembly. It is to be understood, however, that any appropriate method may be used for this purpose.

Figure 6:
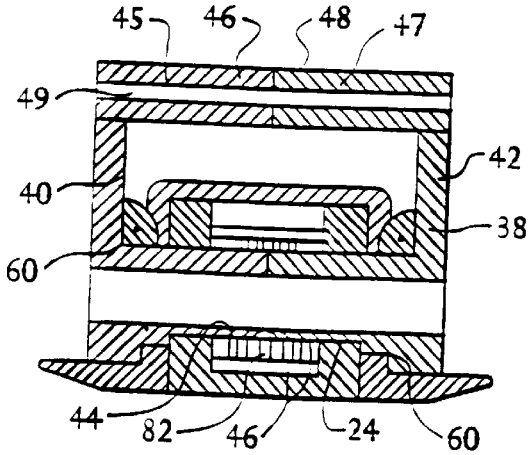
FIG. 6 is a partial sectional view of the handle assembly of FIG. 3 taken along the line 6—6 of FIG. 3.

A sealing means of the o-ring type 60 may also be included (FIG. 6). An o-ring 60 may be received over each of the respective first shafts 42, 43 (FIG. 3) for providing additional sealing of the housing 26 against the first shafts 42, 43. Preferably, the sealing means 60 is of an electrically conductive material for preventing the passage of electromagnetic radiation; however, the sealing means 60 may be formed from any suitable material.

As shown in FIGS. 15 and 16, the first and second lever members 40, 41 are also provided with respective second shafts 46, 47 extending from respective second ends thereof. The second shafts 46, 47 are also adapted to interconnect in the manner described above, also forming a one piece integral shaft member 48 upon assembly (FIG. 6). Each second shaft 46, 47 has a generally cylindrical opening or aperture 45 formed therein, so that when the second shafts 46, 47 are interconnected, a continuous generally cylindrical opening 49 is formed in the integral second shaft member.

The handle assembly 22 is assembled by placing the handle 24 within the housing 26 such that the openings 56 in the handle 24 are aligned with the openings 37 in the housing 26. The o-rings 60 are then placed over the respective first shafts 42, 43 of the two lever members 40, 41, and the first shafts 42, 43 are inserted through the openings 37 in the housing 26 and the aligned openings 56 in the handle 24; so that both the first shafts 42, 43 and the second shafts 46, 47 matingly interconnect such that the assembled lever members 40, 41 form the pivot arm 38. Care is taken to assemble the pivot arm 38 so that the desired angle or orientation between the pivot arm 38 and the handle 24 is obtained. The lever arms 40, 41 are then permanently secured together by appropriate means. Thus, assembled, the handle assembly 22 extends through the housing 26, with the pivot arm 38 extending out the back of the housing 26 proximate one end thereof.

When the handle assembly 22 is in the closed position, the handle assembly 22 is generally flush with the outer surface 25 of the housing 26, and thus also with the cabinet door 202. The central latch 20 is opened by first releasing a catch 80 FIG. 9 as described more fully below, and then rotating the handle assembly 22 around a first pivot axis up and out of the housing 26, through an angle of approximately 90 degrees, until the handle 24 is roughly perpendicular to the outer surface 25 of the housing 26. The pivot arm 38, which extends from the back of the housing 26, is likewise rotated through an angle of approximately 90 degrees as the handle 24 is rotated from a closed to an open position. As noted above, the second integral shaft 48 is positioned at one end of the pivot arm 38, and has a generally cylindrical aperture 49 extending there-through. The aperture 49 is formed therein for rotatably receiving therein one arm of a generally "S"-shaped link or connecting member 62 for a purpose described below, thereby forming a second pivot axis.

As shown in FIGS. 9 and 14, in the multi-point latching system 10 of the present invention, the handle 24 extends a distance L from the axis upon which the handle assembly 22 rotates within the housing 26 (the first pivot axis). The distance from the first pivot axis to the second pivot axis is shown as "P" in FIG. 14. Preferably, the ratio L/P is at least 2.5/1, and more preferably at least 4/1, thereby providing substantial mechanical advantage for opening and closing the multi-point latching system 10 of the present invention.

Figure 2:
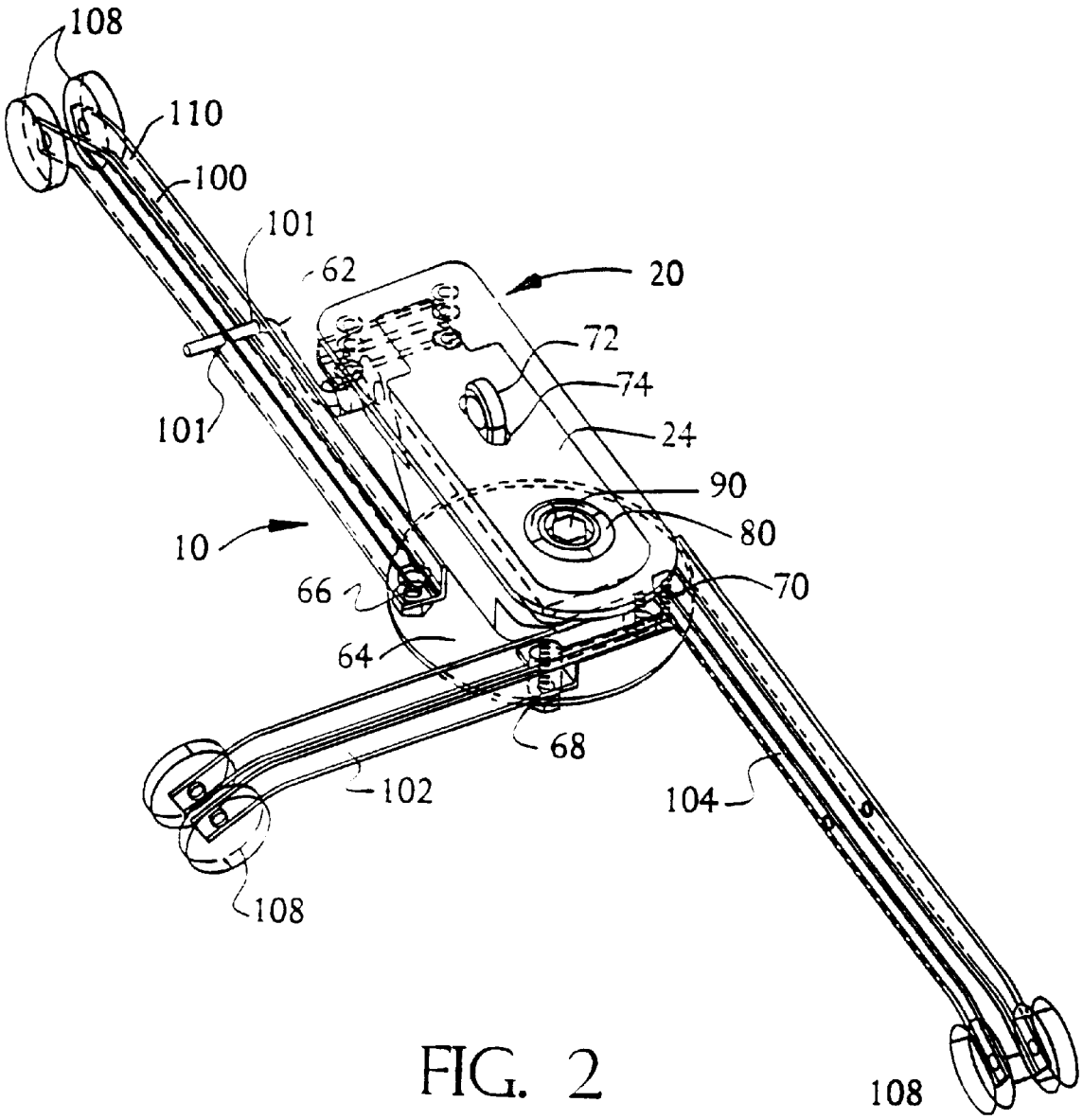
FIG. 2 is a perspective view of the multi-point latching system of FIG. 1 shown for clarity without the cabinet door and the cabinet frame, shown in a closed and latched position.

As best seen in the partial perspective view of FIG. 2, the multi-point latching system 10 also includes a first connection means or remote latching rod 100, which is preferably formed from "U"-shaped channel stock from an appropriate material, such as sheet steel. One end of a generally "S"-shaped link member or link 62 is rotatably received in a pair of apertures 101 formed in the first latching rod 100. The other end of the "S"-shaped link extends through both the aperture 49 formed in second integral shaft 48 of the pivot arm 38.

While the link 62 and first remote latching rod 100 are shown in FIGS. 1–4 as being mounted on the left side of the central latch 20, for mounting the central latch 20 proximate the left side of the cabinet door 202, the link 62 and first remote latching rod 100 can also be mounted on the right side of the central latch 20 in cases in which the cabinet door 202 is hinged on the left side and the central latch 20 is mounted proximate the right side of the cabinet door 200 (not shown).

When the handle 24 is rotated out from the housing 26, the pivot arm 38 rotates and cooperates with the first remote latching rod 100 through the generally "S"-shaped link 62 to cause the first remote latching rod 100 to move from a latched to an unlatched position through a generally linear displacement.

The first remote latching rod 100 includes a first end 110 to which are affixed a pair of rollers 108. As best seen in FIG. 1, the first remote latching rod 100 is slideably secured to the inside of the door 202 by a bracket 120 affixed to the door 202 proximate the edge thereof. When the first remote latching rod 100 moves from an unlatched to a latched position, the rollers 108 roll over and against the inside of the cabinet 200, thereby compressing the gasket 210 and latching and sealing the door 202. Similarly, when the first remote latching rod 100 moves from a latched to an unlatched position, the rollers 108 are linearly displaced out of contact with the inside of the cabinet 200, thereby releasing the pressure applied in the latched position on the gasket 210 and unsealing the door 202.

Figure 17:
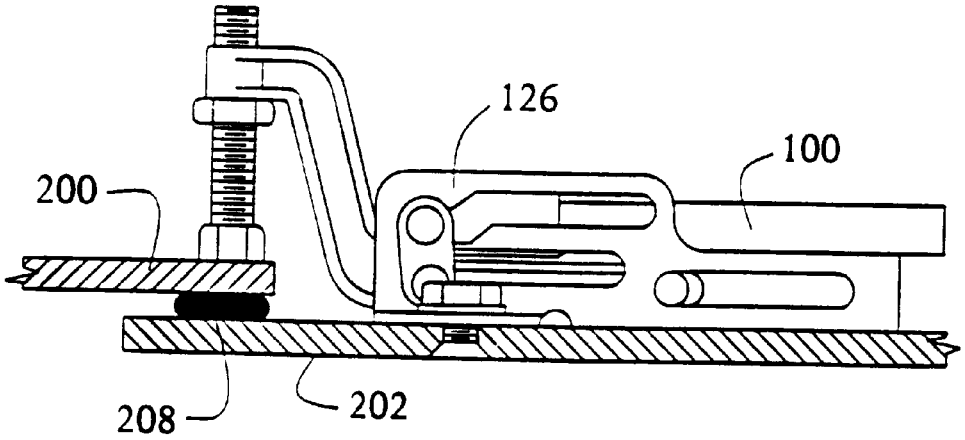
FIG. 17 is a side elevational view of an over-center latch for use in the multi-point latching system of the present invention.

In an alternative embodiment shown in FIG. 17, the remote latching rod 100 actuates a conventional over-center latch 126 positioned on the door 202 proximate the edge thereof, to latch the door 202 and compress the gasket 210 to seal the door 202 to the cabinet 200.

Figure 4:
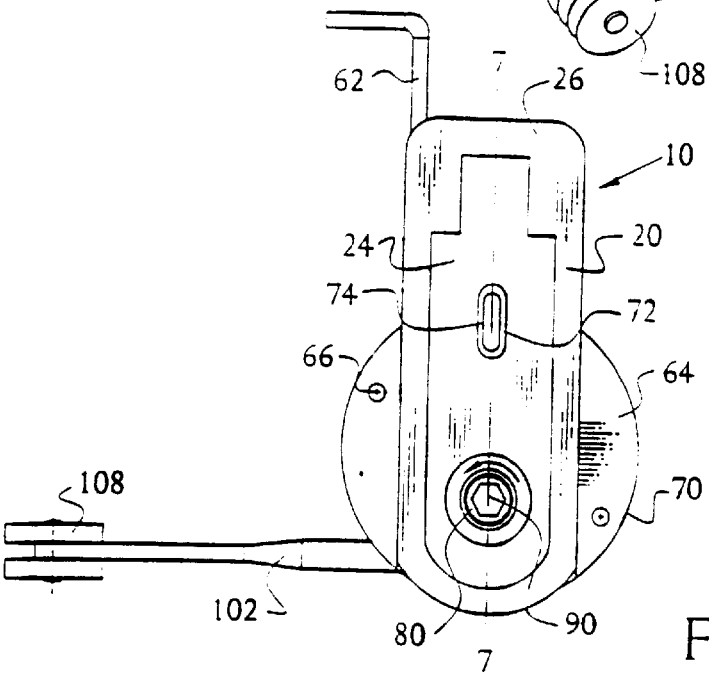
FIG. 4 is top plan view of the multi-point latching system of FIG. 3 shown in the closed position.

As can be seen in the perspective view of FIG. 2, the central operating latch 20 also includes a generally circular actuator plate 64 rotatably mounted on the bottom of the housing 26 (FIG. 3), the actuator plate 64 having a plurality of a plurality of apertures 66, 68 formed therein proximate the periphery thereof (FIGS. 2, 4). A second end 110 of the first remote latching rod 100 is pivotably affixed to the actuator plate 64 in a first aperture 66 thereof. When the handle 22 is rotated in or out of the housing 26, the first remote latching rod 100 is displaced by the pivot arm 38 as described above, and the first latching rod 100 itself imparts an angular displacement to the actuator plate 64. In this instance, the first remote latching rod 100 and the link 62 comprise means linking the pivot arm 38 and the actuator plate 64.

Preferably, a second and a third connection means or remote latching rods 102, 104 are also pivotably mounted at one respective end thereof to the actuator plate 64 through respective apertures 68, 70 therein, and are provided with rollers 108 at the other end thereof and slidably secured to the cabinet door 202 with respective brackets (not shown). Alternatively, the second and third remote latching rods 102, 104 are operatively connected to over-center latches positioned proximate the edges of the cabinet door 202 (not shown). Thus, when the handle 22 is rotated out of the housing 26, each of the first, second and third remote latching rods 100, 102, 104 is displaced from a latched to an unlatched position. Similarly, when the handle 22 is rotated into the housing 26, the handle 22 through the pivot arm 38 and the link 62 imparts an angular displacement to the actuator plate 64 and thus a generally linear displacement to each of the second and third remote latching rods 102, 104, the generally linear displacement moving each of the remote latching rods 102, 104, 106 from an unlatched to a latched position.

As shown in the cross sectional view of FIG. 7, in one embodiment of the present invention, a hasp 72 is formed in the housing 26, and a corresponding hasp aperture 74 is formed in the handle 24 so that the hasp 72 passes through the hasp aperture 74 when the central latch 20 is closed. The hasp 72 extends above the outer or upper surface 25 of the housing 26 so that the central latch 20 can be padlocked for additional security (not shown).

The central latch 20 is preferably released from a latched position by operating a locking member or catch 80 (FIG. 2) mounted proximate one end of the handle 24 in an opening formed in the handle 24. A shown in FIG. 9, the catch 80 includes a rotatable stud 90 having a head 91, which can be operated by engaging the head 91 with a matching tool (not shown), and rotating the tool. The internal geometry of the opening in the stud 90 is selected to match the corresponding tool, so that a specific tool or key is required to operate and release the central operating latch 20, thereby providing an additional measure of security to the multi-point operating system 10 of the present invention. For example, the head 91 may have a hexagonal shape engageable with a conventional socket, or the head 91 may be specially formed to match a special tool for security purposes.

As shown in FIGS. 9–11, in a presently preferred embodiment, the stud 90 at one end thereof is provided with a cross-pin 92, so that the cross pin 92 turns when the stud 90 is rotated using the required tool. When the central latch 20 is closed, the cross-pin 92 is oriented in a locked position and securely engages a keeper 93 formed on the inside of the housing 26 proximate one end thereof (FIG. 11), such that the stud 90 cannot be rotated to release the latch 20 without application of some minimum force otherwise provided by use of the tool.

As can be seen in FIG. 9, a biasing means or small torsion spring 94 is mounted on a projection 96 formed on the inside of the handle 24, such that when the stud 90 is rotated to open the central operating latch 20, the small torsion spring 94 is compressed. When the cross-pin 92 has been rotated out of the keeper 93, the main biasing means or torsion spring 82 (FIGS. 6, 7) rotates the handle 24 out and away from the housing 26, so that the operator can grasp and further rotate the handle 24 outwards, and thus release the multi-point latch system 10 of the present invention. After the handle 24 has been released from the keeper 93, the small torsion spring 94 is released, and the small torsion spring 94 then urges the cross-pin 92 and stud 90 to rotate back to the locked orientation. A camming surface 84 (FIG. 11) is provided on the upper surface of the keeper 93 so that when the handle 24 is rotated inward to close the central operating latch 20, the cross-pin 92 engages the camming surface 84 and is rotated through a small angle permitting the handle 24 to be fully received within the housing 26. When the handle 24 has been fully received within the housing 26, the small torsion spring 94 urges the cross-pin 92 to rotate into the keeper 93, thereby locking the handle 24 to the housing 26.

Figure 8:
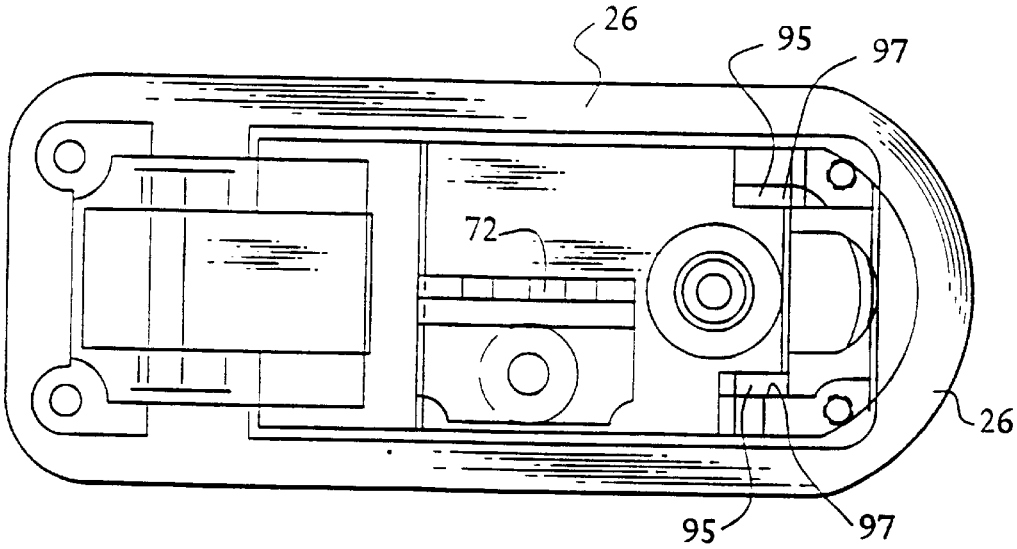
FIG. 8 is a top plan view of the housing of FIG. 7.

In an alternative embodiment, the cross-pin 92 engages each of a pair of keepers 95 (FIGS. 7, 8) with corresponding camming surfaces 97 formed inside the housing 26, to more securely lock the handle 24.

In a presently preferred embodiment, the hasp 72 is replaced by a lock cylinder 130 mounted in the handle (FIG. 13), and a corresponding keeper (not shown) is provided in the housing 26, so that a conventional key can be used to secure the central operating latch 20.

Various modifications can be made in the details of the various embodiments of the apparatus of the present invention, all within the scope and spirit of the invention and defined by the appended claims.

We claim:

1. A multi-point latching system adapted for mounting on a panel and securing the panel to a frame, the system comprising:

a) a central latch comprising:

a housing having a back;

a handle assembly pivotably mounted in the housing for rotation about an axis parallel to the panel for opening and closing the central latch; the handle assembly extending through the housing and including a handle and a pivot arm, the pivot arm extending inwardly from the back of the housing;

an actuator pivotably mounted for rotation normal to the panel; and link means connecting the handle assembly and the actuator such that the actuator is rotated by rotating the handle assembly;

b) at least one remote latching means for securing the panel to the frame; and c) connection means extending between the actuator and the at least one remote latching means such that the at least one remote latching means is operated when the actuator is rotated.

2. A multi-point latching system according to claim 1 wherein the system comprises at least a first connection means and a second connection means and respective first and second remote latching means, and the link means connecting the handle assembly and the actuator includes the first connection means.

3. A multi-point latching system according to claim 2 wherein the link means further comprises a link member, the link member being pivotably attached to the handle assembly and pivotably attached to the first connection means.

4. A multi-point latching system according to claim 1 wherein the at least one remote latching means comprises at least one roller means.

5. A multi-point latching system according to claim 1 wherein the at least one remote latching means comprises an over-center latch.

6. An enclosure including a panel, frame and multi-point latching system, the multi-point latching system, the system comprising:

a) a central latch comprising:

a housing having a back;

a handle assembly pivotably mounted in the housing for rotation about an axis parallel to the panel for opening and closing the central latch; the handle assembly extending through the housing and including a handle and a pivot arm, the pivot arm extending inwardly from the back of the housing;

an actuator pivotably mounted for rotation normal to the panel; and link means connecting the handle assembly and the actuator such that the actuator is rotated by rotating the handle assembly;

b) at least one remote latching means for securing the panel to the frame; and c) connection means extending between the actuator and the at least one remote latching means such that the at least one remote latching means is operated when the actuator is rotated.

* * * * *